US011220792B2

(12) United States Patent
Kommeter et al.

(10) Patent No.: US 11,220,792 B2
(45) Date of Patent: Jan. 11, 2022

(54) STRUCTURAL ELEMENT FOR FORMING A GROUND COVERING

(71) Applicant: ARSRATIO GMBH, Kirchbichl (AT)

(72) Inventors: Marion Kommeter, Kufstein (AT); Stefan Gruber, Landl (AT)

(73) Assignee: ARSRATIO GMBH, Kirchbichl (AT)

( * ) Notice: Subject to any disclaimer, the term of this patent is extended or adjusted under 35 U.S.C. 154(b) by 29 days.

(21) Appl. No.: 16/632,813

(22) PCT Filed: Apr. 23, 2018

(86) PCT No.: PCT/EP2018/060290
§ 371 (c)(1),
(2) Date: Jan. 21, 2020

(87) PCT Pub. No.: WO2019/020224
PCT Pub. Date: Jan. 31, 2019

(65) Prior Publication Data

US 2020/0165782 A1 May 28, 2020

(30) Foreign Application Priority Data

Jul. 24, 2017 (DE) ..... 10 2017 116 603.3

(51) Int. Cl.
*E01C 5/00* (2006.01)
*E01C 5/22* (2006.01)

(52) U.S. Cl.
CPC ..... *E01C 5/22* (2013.01); *E01C 2201/12* (2013.01)

(58) Field of Classification Search
CPC ..... E01C 5/22; E01C 2201/12
USPC ..... 404/34–41
See application file for complete search history.

(56) References Cited

U.S. PATENT DOCUMENTS 3,969,851 A * 7/1976 Whitacre ..... E01C 5/003 52/98
7,413,374 B2 * 8/2008 Rogers ..... E01C 9/086 404/35
7,591,605 B2 * 9/2009 Jonasz ..... E01F 9/529 404/15
7,757,449 B2 * 7/2010 Portoles Ibanez ..... E04F 15/02016 52/384
7,918,057 B2 * 4/2011 Moller, Jr. ..... E01C 5/20 52/177
7,930,865 B2 * 4/2011 Barlow ..... E04F 15/105 52/741.11
8,070,382 B2 * 12/2011 Prinz ..... E01C 13/045 404/35
8,166,722 B2 * 5/2012 Moller, Jr. ..... E04F 15/10 52/588.1

(Continued)

FOREIGN PATENT DOCUMENTS

CN 2207415 Y 9/1995
DE 102013106302 A1 12/2014

(Continued)

*Primary Examiner* — Raymond W Addie
(74) *Attorney, Agent, or Firm* — Lucas & Mercanti, LLP; Klaus P. Stoffel

(57) ABSTRACT

A structural element for forming a ground covering, in particular in an outdoor area, including a rectangular tile. A molded-on portion which is made of a plastic material and runs around the edge of the tile like a frame is preferably injection-molded and/or foamed onto the tile.

13 Claims, 3 Drawing Sheets

(56) References Cited

U.S. PATENT DOCUMENTS

| | | | | |
|---|---|---|---|---|
| 8,236,392 | B2 * | 8/2012 | Sawyer | E01C 3/006 428/17 |
| 2010/0104361 | A1 * | 4/2010 | Walpot | E01C 5/223 404/13 |
| 2014/0093677 | A1 | 4/2014 | Permesang | |
| 2014/0161525 | A1 * | 6/2014 | Smith | E01C 5/18 404/41 |

FOREIGN PATENT DOCUMENTS

| | | | |
|---|---|---|---|
| DE | 102013224478 | A1 | 6/2015 |
| WO | 2007144244 | A2 | 12/2007 |
| WO | 2013000456 | A1 | 1/2013 |

* cited by examiner

STRUCTURAL ELEMENT FOR FORMING A GROUND COVERING

The present application is a 371 of International application PCT/EP2018/060290, filed Apr. 23, 2018, which claims priority of DE 10 2017 116 603.3, filed Jul. 24, 2017, the priority of these applications is hereby claimed and these applications are incorporated herein by reference.

BACKGROUND OF THE INVENTION

The invention relates to a structural element for forming a ground covering, in particular in an outdoor area, comprising a rectangular slab.

For forming ground coverings in outdoor areas, it is known to lay stoneware slabs, for example of concrete or natural stone, in a bed of sand and/or chippings. The slabs are largely secured against horizontal displacement by material penetrating into joints between the slabs during the embedding.

SUMMARY OF THE INVENTION

The invention is based on the object of providing a novel structural element of the type mentioned at the beginning by which the formation of ground coverings is facilitated, while increasing the quality of the covering.

The structural element achieving this object according to the invention is characterized by a molded-on formation of a plastics material that borders the edge of the slab in a frame-like manner.

The molded-on formation of plastics material according to the invention allows a very uniform, esthetic pattern of joints to be produced in an easy way when laying the structural elements, by forming butt joints between the molded-on formations.

In a particularly preferred embodiment of the invention, the frame-like bordering molded-on formation is injection-molded and/or foamed onto the slab when the slab is arranged in a mold cavity.

While metal or glass slabs also come into consideration as slabs, the slab preferably consists of stoneware, in a particularly preferred embodiment of fine stoneware.

The molded-on formation expediently comprises a cover portion covering the slab edge areas in a bordering manner to form half a joint filling.

While in the interconnected covering assembly just a butt joint could be formed by the molded-on formation between the structural elements, in particular between the cover portions, the molded-on formation preferably has devices for connecting such structural elements forming the ground covering to one another at the edges.

In particular, the molded-on formation comprises a portion projecting downward beyond the underside of the slab, the aforementioned connecting devices preferably being formed by this portion of the molded-on formation.

The connecting devices expediently comprise elements for plug-in connection hi a vertical or horizontal direction of insertion.

In a particularly preferred embodiment of the invention, the portion of the molded-on formation projecting beyond the underside of the slab has on two edge sides of the slab that are perpendicular to one another a connecting strip with insertion holes and, on the two other edge sides of the slab, insertion lugs arranged under the slab. The insertion holes and insertion lugs could also be arranged the other way round.

The portion projecting beyond the underside of the slab preferably has a projecting length of 5 to 10 mm, in particular of 8 mm.

The thickness of the slab is expediently >10 mm, in particular ≥20 mm.

The area of the underside of the slab that is framed by the molded-on formation is preferably free from molded-on formations. By concentrating molded-on formations on the edge region of the slab, when laying the structural elements in a bed of sand and/or chippings, the frame-like molded-on formation can penetrate more easily into the bed, which gives the covering stable horizontal retention.

BRIEF DESCRIPTION OF THE DRAWING

The invention is further explained below on the basis of exemplary embodiments and the accompanying drawings relating to these exemplary embodiments, in which.

DETAILED DESCRIPTION OF THE INVENTION

Figure 1:
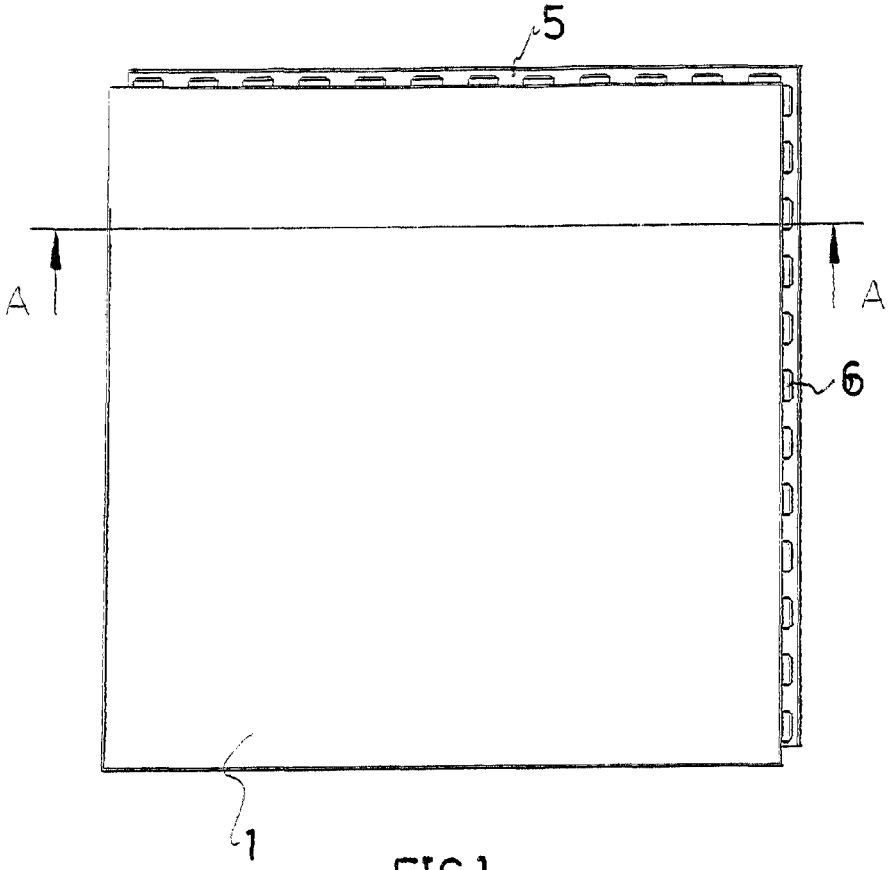
FIG. 1 shows a structural element according to the invention in a plan view.

A structural element represented in plan view in FIG. 1 for forming a ground covering, for example in an outdoor area exposed to weathering, comprises a slab 1, which in the example shown consists of fine stoneware and has a thickness of 20 mm. The edge side length of the square slab is 60 cm.

The slab 1 is connected to a molded-on formation 2, which is formed bordering the edge of the slab in a frame-like manner, has been injection-molded onto the slab 1 in a mold (not shown) and in the example shown consists of polyurethane (PU). In the course of the molding-on and foaming-on, a material-bonding connection is produced between the slab 1 and the molded-on formation 2.

Figure 2:
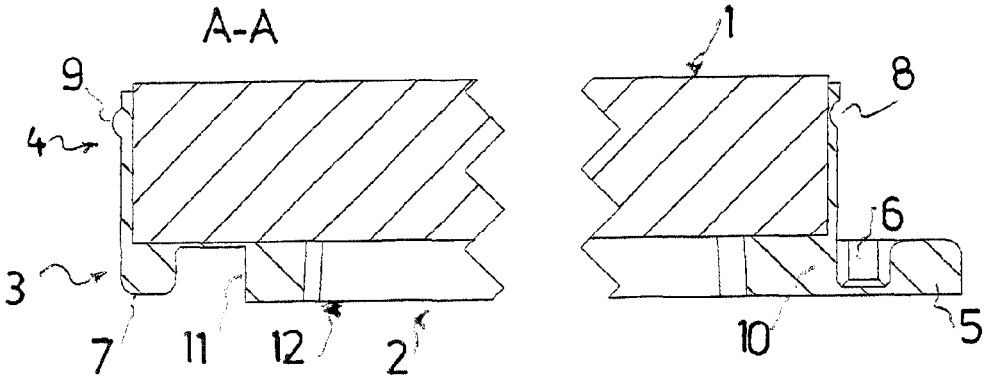
FIG. 2 shows the structural element according to the invention from FIG. 1 in a sectional side view.
Figure 3:
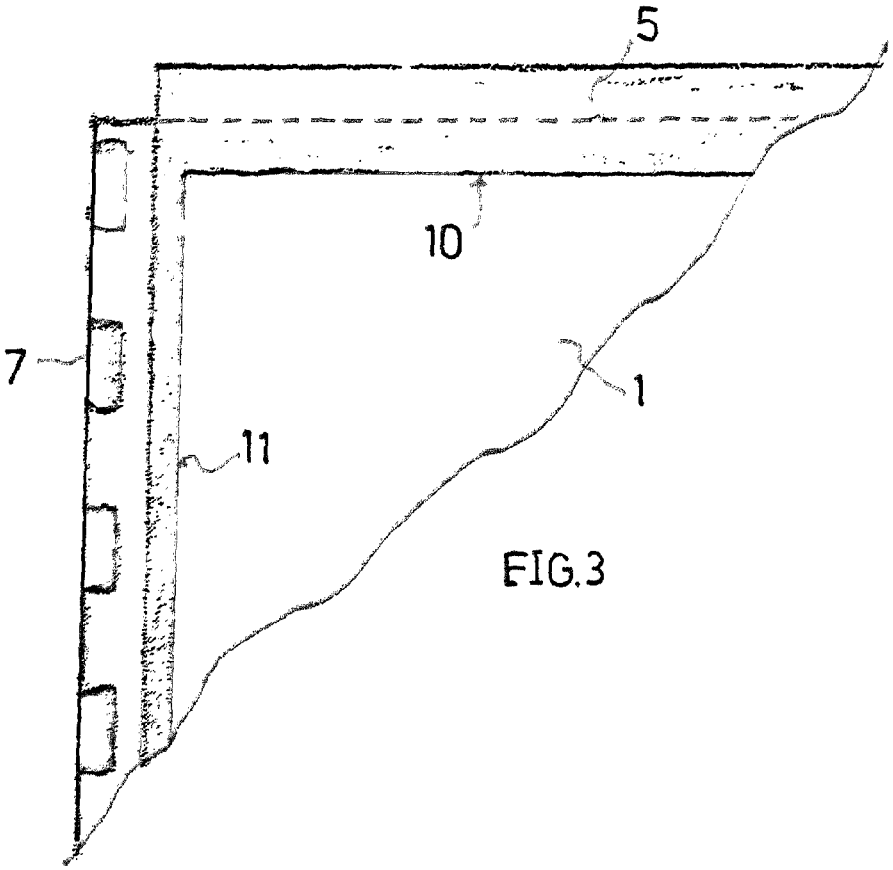
FIG. 3 shows the structural element from FIG. 1 in a partial view from below.

As FIG. 1 to 3 reveal, the frame-like bordering molded-on formation 2 comprises a portion 3, which projects downward beyond the underside of the slab 1, and a portion 4, which forms a cover bordering the edge area of the slab 1, the thickness of which corresponds to half a joint width.

While the portion 4 forming the bordering cover therefore serves for the formation of a joint filling, devices for connecting such structural elements to one another are formed by the portion 3 projecting downward beyond the underside of the slab 1. As such devices, the portion has respectively on two edge sides of the slab 1 that are perpendicular to one another a frame leg 10 with a connecting strip 5 protruding beyond the edge of the slab a row of insertion holes 6 extending in the longitudinal direction of the strip. On the two other edge sides of the slab 1 that are perpendicular to one another, frame legs 11 with insertion lugs 7 are formed by the downwardly projecting portion 3 in a way corresponding to the insertion holes 6.

On the edge sides of the base plate 1 having the connecting strips 5, the cover formed by the portion 4 has recesses 8 and, on the other edge sides, protuberances 9.

In the laying of the structural element, the portion 3 of the molded-on formation 2 that projects beyond the underside and forms the frame legs 10 and 11 on sides of the slab that are respectively perpendicular to one another lies with a frame-like, planar underside 12 on an underlying base.

The underlying base may be a concrete base. In this case, the slab maintains a distance from the underlying base, so that loads on top are transferred from the slab to the underlying base by way of the molded-on formation 2 alone.

Alternatively, the underlying base may comprise a layer of sand and/or chippings. In an uncompacted uppermost layer of sand or chippings, the structural element sinks in slightly with the projecting portion 3 of the molded-on formation 2, until the slab 1, comes to lie on the uppermost layer. Loads are therefore transferred not only by way of the molded-on formation 2 but also directly from the slab 1 to the underlying base.

For the formation of a ground covering, the structural elements are hooked vertically to one another at the edges, the insertion lugs 7 penetrating into the insertion holes 2 to establish a frictional connection. It goes without saying that an interlocking snap-in connection can also be produced by the insertion holes and lugs. This connection between the structural elements gives the ground covering that is formed great stability.

In the interconnected assembly, the portion 4 of the molded-on formation 2 of each structural element forms half a joint filling. A uniform joint pattern is obtained by the portions 4 of adjacent structural elements lying directly against one another. The recesses 8 and protuberances 9 ensure that the structural elements of the covering are not offset vertically.

Figure 4:
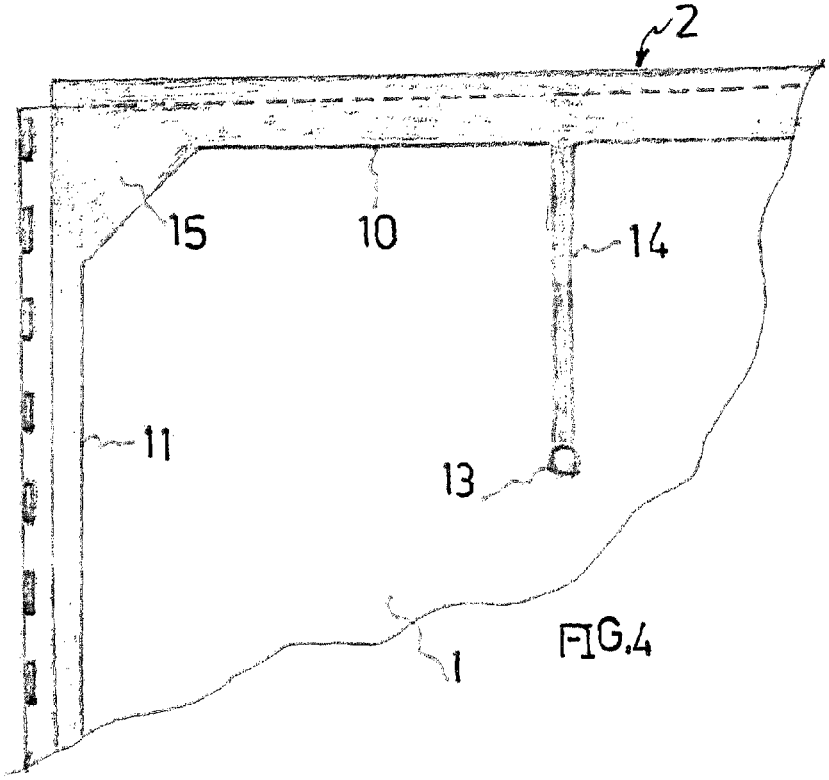
FIG. 4 shows a second exemplary embodiment of a structural element according to the invention in a partial view from below.

In the case of the exemplary embodiment shown in FIG. 1 to 3, a gating point (not shown) is formed directly on the frame-like molded-on formation 2. In the case of the exemplary embodiment from FIG. 4, a gating point 13 is arranged away from the frame-like molded-on formation 2. From the gating point 13, a gating strand 14 connected to the slab 1 extends to the frame part 10 having the insertion holes 6 in the connecting strip 5.

As a further difference from the exemplary embodiment from FIGS. 1 to 3, the molded-on formation 2 respectively has in the corner regions a widening 15, which advantageously reduces the surface pressure in the corner regions.

Figure 5:
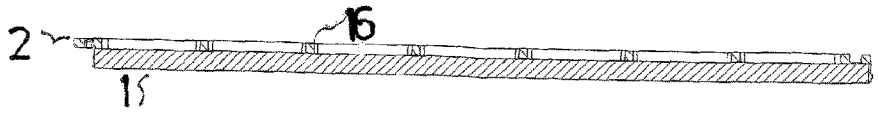
FIGS. 5 to 7 show a third exemplary embodiment of a structural element according to the invention in various views.
Figure 6:
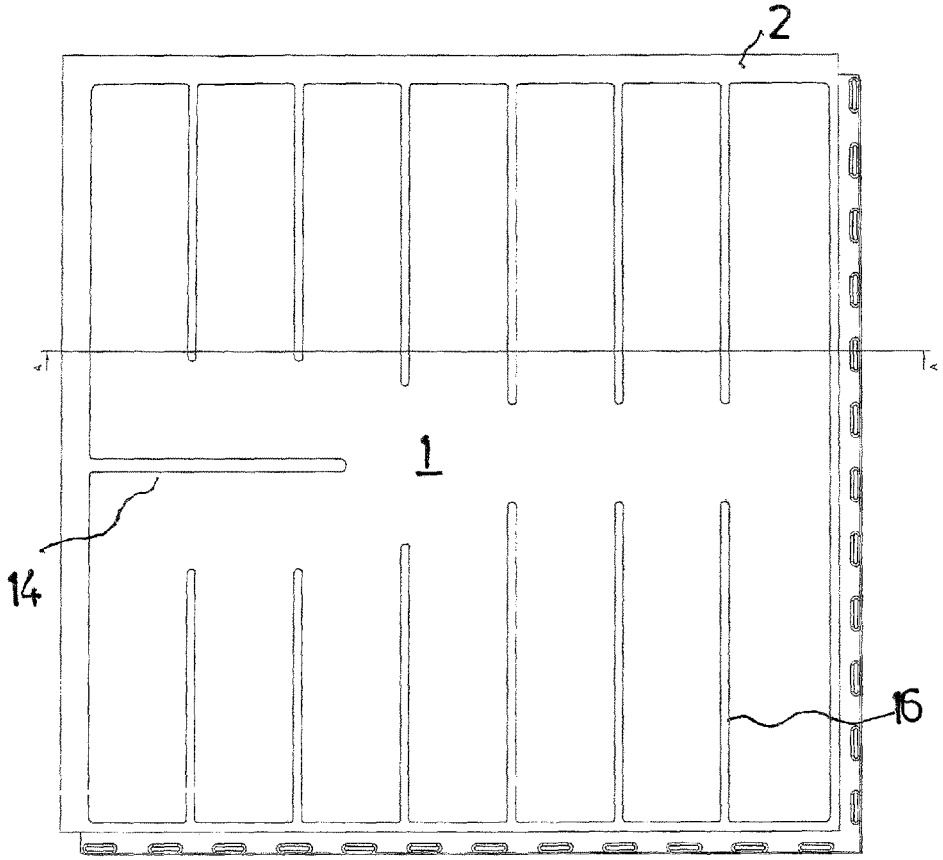
Figure 7:
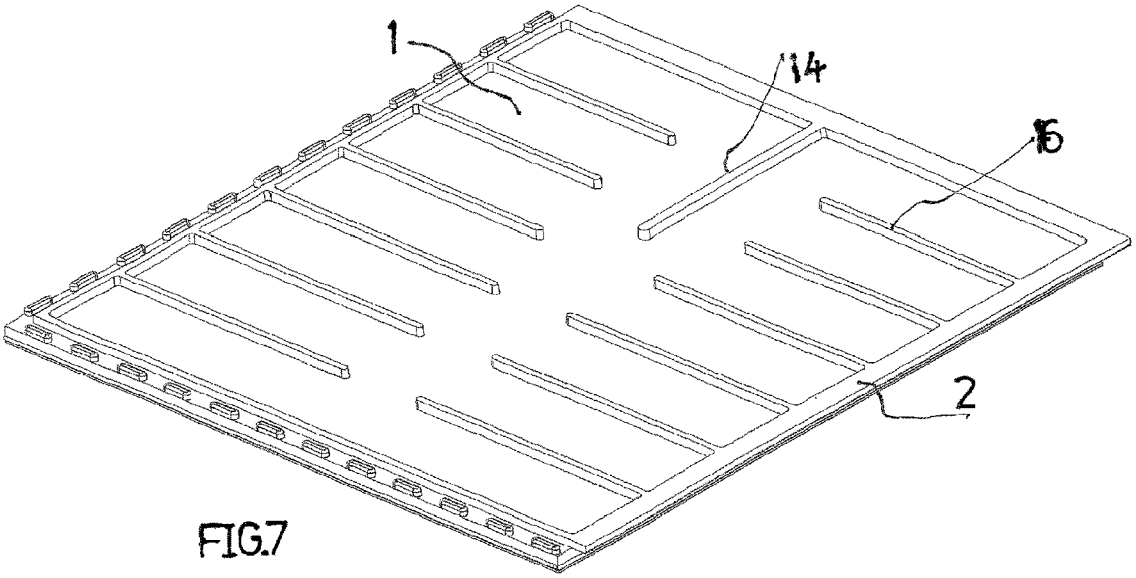

In the case of an exemplary embodiment shown in FIGS. 5 to 7, also molded on a slab 1 and a frame-like molded-on formation 2 are webs 16, which extend inward from mutually opposite frame legs of the molded-on formation 2 and respectively end freely. The width of the webs 16 aligned in relation to one another in the example concerned is significantly less than the width of the frame legs. In the example, the webs 16 coincide with the molded-on formation 2 in their height projecting from the slab 1. A gating web perpendicular to the webs 16 is denoted by 14.

The webs advantageously counteract horizontal displacement of the structural elements, in particular on a loose underlying base.

The invention claimed is:

1. A structural element for forming a ground covering, comprising:

a rectangular slab made of stoneware, glass or metal; and a molded-on formation of a plastic material that borders an edge of the slab in a frame-like manner, wherein the molded-on formation frames an area of an underside of the slab that is free from formations or, apart from at least one gating strand and/or webs projecting inwardly from the molded-on formation, the area of the underside is free from formations.

2. The structural element according to claim 1, wherein the molded-on formation is injection-molded and/or foamed onto the slab.

3. The structural element according to claim 1, wherein the slab is fine stoneware.

4. The structural element according to claim 1, wherein the molded-on formation comprises a cover portion that covers a slab edge area in a bordering manner to form half a joint filling.

5. The structural element according to claim 1, wherein the molded-on formation comprises devices for connecting additional of the structural elements to one another at the edges.

6. The structural element according to claim 5, wherein the connecting devices comprise elements for plug-in connection in a vertical or horizontal direction of insertion.

7. The structural element according to claim 5, wherein the molded-on formation comprises a portion that projects downward beyond an underside of the slab.

8. The structural element according to claim 7, wherein the connecting devices are formed by the portion of the molded-on formation that projects beyond the underside of the slab.

9. The structural element according to claim 7, wherein the portion of the molded-on formation projecting beyond the underside of the slab has on two edge sides of the slab that are perpendicular to one another a connecting strip with insertion holes and, on the two other edge sides of the slab, insertion lugs arranged under the slab.

10. The structural element according to claim 7, wherein the portion projecting beyond the underside of the slab projects approximately 5 to 10 mm.

11. The structural element according to claim 10, wherein the portion projects 8 mm.

12. The structural element according to claim 1, wherein the slab has a thickness of >10 mm.

13. The structural element according to claim 12, wherein the thickness is >20 mm.

* * * * *